US010202765B2

(12) United States Patent
Kim

(10) Patent No.: US 10,202,765 B2
(45) Date of Patent: Feb. 12, 2019

(54) DECK PANEL FOR CONSTRUCTION

(71) Applicant: Kwang Sub Kim, Incheon (KR)

(72) Inventor: Kwang Sub Kim, Incheon (KR)

(73) Assignee: Kwang Sub Kim, Incheon (KR)

( * ) Notice: Subject to any disclaimer, the term of this patent is extended or adjusted under 35 U.S.C. 154(b) by 3 days.

(21) Appl. No.: 15/533,548

(22) PCT Filed: Nov. 30, 2015

(86) PCT No.: PCT/KR2015/012895
§ 371 (c)(1),
(2) Date: Jun. 6, 2017

(87) PCT Pub. No.: WO2016/093527
PCT Pub. Date: Jun. 16, 2016

(65) Prior Publication Data

US 2017/0328061 A1 Nov. 16, 2017

(51) Int. Cl.

| | |
|---|---|
| ***E04B 5/40*** | (2006.01) |
| ***E04C 5/065*** | (2006.01) |
| *E04B 5/10* | (2006.01) |
| *E04B 5/14* | (2006.01) |

(52) U.S. Cl.
CPC ..... *E04B 5/40* (2013.01); *E04C 5/065* (2013.01); *E04B 5/10* (2013.01); *E04B 5/14* (2013.01)

(58) Field of Classification Search
CPC ... E04C 5/065; E04B 5/40; E04B 5/10; E04B 5/14
USPC ... 52/649.1, 745.21, 223.6, 654.1, 414, 319, 52/335, 336, 337, 600, 630
See application file for complete search history.

(56) References Cited

U.S. PATENT DOCUMENTS 3,012,639 A * 12/1961 Pavlecka ..... E04B 1/6158 52/275
3,195,920 A * 7/1965 Knisely ..... B62D 25/188 122/31.1
4,055,927 A * 11/1977 Tamaro ..... E02D 5/20 264/35

(Continued)

FOREIGN PATENT DOCUMENTS

JP 0754428 2/1995
JP 09203143 8/1997

(Continued)

OTHER PUBLICATIONS

International Search Report—PCT/KR2015/012895 dated Mar. 30, 2016.

*Primary Examiner* — Joshua K Ihezie
(74) *Attorney, Agent, or Firm* — Cantor Colburn LLP

(57) ABSTRACT

Provided is a deck panel for construction, including: an upper side deck panel which includes an upper side deck plate, an upper side truss girder which is disposed on the upper side deck plate, and an upper side reinforcement part which is coupled to the upper side deck plate or the upper side truss girder; a lateral side deck panel which includes a lateral side deck plate, a lateral side truss girder which is disposed on the lateral side deck plate, and a lateral side reinforcement part which is coupled to the lateral side deck plate or the lateral side truss girder, and is disposed on at least one lateral side of the upper side deck panel; and a coupling member which fixes the upper side deck panel and the lateral side deck panel.

14 Claims, 17 Drawing Sheets

(56) References Cited

U.S. PATENT DOCUMENTS

| | | | | | |
|---|---|---|---|---|---|
| 5,163,493 | A * | 11/1992 | Kraeutler | E06B 3/485 | 16/272 |
| 5,235,791 | A * | 8/1993 | Yaguchi | E04B 5/38 | 52/319 |
| 5,471,811 | A * | 12/1995 | House | E01F 8/0011 | 256/13.1 |
| 5,887,404 | A * | 3/1999 | Kreizinger | B28B 7/20 | 256/19 |
| 5,920,936 | A * | 7/1999 | Wiedeck | E01D 15/124 | 14/13 |
| 6,006,483 | A * | 12/1999 | Lee | E04B 5/38 | 52/319 |
| 6,446,398 | B2 * | 9/2002 | Weir | E04H 17/168 | 160/135 |
| 9,476,219 | B2 * | 10/2016 | Skolnekovich | E04H 1/1205 | |
| 2004/0094689 | A1 * | 5/2004 | Rose | E04G 13/02 | 249/6 |
| 2010/0319285 | A1 * | 12/2010 | Jewett | E04B 1/161 | 52/309.4 |
| 2012/0240497 | A1 * | 9/2012 | O'Brien | E04B 5/43 | 52/223.6 |
| 2013/0047545 | A1 * | 2/2013 | Standal | E04C 5/04 | 52/649.1 |

FOREIGN PATENT DOCUMENTS

| | | | |
|---|---|---|---|
| JP | 2001049621 | | 2/2001 |
| JP | 2003166310 | | 6/2003 |
| KR | 100579440 | | 5/2006 |
| KR | 20100024768 | A * | 3/2010 |

* cited by examiner

DECK PANEL FOR CONSTRUCTION

TECHNICAL FIELD

The present disclosure relates to a deck panel for construction including a coupling member for coupling the deck panels.

BACKGROUND ART

Recently, reinforced concrete structures are most widely used for construction process methods because the reinforced concrete structure has excellent rigidity, durability, fire resistance, earthquake resistance, and soundproof performance.

In the case of a mold process method in the related art, which is used to construct a building with the reinforced concrete structure, a process is complicated, it is difficult to dismantle arranged bars and molds, and a large number of wastes are produced, and as a result, recently, a process method using a deck panel is used to construct floor or ceiling slabs.

Here, the deck panel broadly includes a deck plate and a truss girder.

The deck plate serves as not only a mold, but also a surface of a concrete structure after construction, and the deck plate may be made of a galvanized steel plate in order to prevent corrosion caused by the concrete. The plurality of deck plates is connected to form a floor surface or a ceiling surface of a building.

The truss girder includes a lattice unit which has a predetermined corrugated shape, and a fixing unit which securely fixes the lattice unit, and the lattice unit and the fixing unit are formed as steel reinforcements and may be fastened onto the deck plate.

The deck panel is manufactured at a predetermined place, transported to a construction site, and then disposed on a floor or a ceiling of a building, and then concrete is poured and cured for a predetermined period of time, such that a structure of the building is constructed.

However, the deck panel in the related art has a problem in that a use of the deck panel is limited only to floor or ceiling slabs of a building, and has a drawback in that an overall period for construction of a building is long.

In addition, because the deck plate and the truss girder are fastened and assembled by welding, the time required to assemble the deck plate and the truss girder is somewhat long, and an assembly tolerance may be incurred.

In addition, a construction method using the deck panel in the related art involves an in-situ process of arranging bars in order to connect the respective deck panels. Therefore, there is a problem in that an overall construction period is increased due to a process of welding at a construction site or a separate reinforcement process of arranging bars, which causes an increase in personnel expenses and material costs and affects quality of construction in accordance with skill of in-situ technicians.

DISCLOSURE

Technical Problem

The present disclosure has been made in an effort to solve the aforementioned problems, and an object of the present disclosure is to provide an environmentally-friendly deck panel for construction, in which a structure of the deck panel is improved and modularized, thereby reducing a period for construction of a reinforced concrete building, reducing construction costs, improving stability and construction quality, and minimizing construction wastes.

In addition, another object of the present disclosure is to provide a deck panel for construction which implements a deck panel structure in which the deck panels, which are disposed on a partitioned building, may be coupled, such that construction of a high-rise building may be simply and quickly performed.

Technical Solution

To achieve the aforementioned objects, the present disclosure provides a deck panel for construction, including: an upper side deck panel which includes an upper side deck plate, an upper side truss girder which is disposed on the upper side deck plate, and an upper side reinforcement part which is coupled to the upper side deck plate or the upper side truss girder; a lateral side deck panel which includes a lateral side deck plate, a lateral side truss girder which is disposed on the lateral side deck plate, and a lateral side reinforcement part which is coupled to the lateral side deck plate or the lateral side truss girder, and is disposed on at least one lateral side of the upper side deck panel; and a coupling member which fixes the upper side deck panel and the lateral side deck panel.

In addition, the upper side deck panel may include an upper side fastening portion which protrudes to the outside of the upper side deck plate, the lateral side deck panel may include a lateral side fastening portion which protrudes to the outside of the lateral side deck plate in a direction of the upper side fastening portion, and the coupling member may include a horizontal coupling member which is disposed in a space formed as the upper side fastening portion and the lateral side fastening portion cross each other.

In addition, the upper side fastening portion may be formed in a ㄷ shape and has a free end that is disposed to be spaced apart from an upper side of the upper side deck plate, the lateral side fastening portion may be formed in a ㄷ shape and has a free end that is disposed to be spaced apart from an upper side of the lateral side deck plate, and the horizontal coupling member may have a rectangular shape and be disposed in a space formed as the upper side fastening portion and the lateral side fastening portion cross each other.

In addition, the horizontal coupling member may include four bars which define respective sides of the rectangular shape, and connecting portions which connect the adjacent bars, and the connecting portion may be formed in a corrugated shape having a predetermined pitch with respect to a facing surface perpendicular to the ground surface.

In addition, the upper side truss girder may include: a pair of lattices which is formed in a predetermined corrugated shape; an upper chord member which is coupled to upper pitches of the pair of lattices and fixes upper portions of the pair of lattices; and a pair of lower chord members which is disposed in parallel with each other at a lower side of the pair of lattices, and the upper side reinforcement part may include: a fifth upper side reinforcement member which is coupled to the free end of the upper side fastening portion and has both ends coupled to the pair of lower chord members; a second upper side reinforcement member which is coupled to the upper chord member, the free end of the upper side fastening portion, and the fifth upper side reinforcement member; a plurality of first upper side reinforcement members which has one end coupled to an inner side at one end of any one pair of lattices among the multiple pairs of lattices, and the other end coupled to an inner side at the other end of another pair of lattices; a pair of third upper side reinforcement members which is coupled to inner sides of the pair of lattices and lower surfaces of the pair of lower chord members, and disposed perpendicular to the pair of lower chord members; and a pair of fourth upper side reinforcement members which is disposed in parallel with each other, and has one fourth upper side reinforcement member perpendicularly coupled to an upper side of the upper chord member, and the other fourth upper side reinforcement member perpendicularly coupled to the pair of lower chord members.

In addition, the upper side fastening portion may be formed on the upper chord member.

In addition, the lateral side truss girder may include: a pair of lattices which is formed in a predetermined corrugated shape; an upper chord member which is coupled to upper pitches of the pair of lattices and fixes upper portions of the pair of lattices; and a pair of lower chord members which is disposed in parallel with each other at a lower side of the pair of lattices, and the lateral side reinforcement part may include: a fifth lateral side reinforcement member which is coupled to the free end of the lateral side fastening portion and has both ends coupled to the pair of lower chord members; a second lateral side reinforcement member which is coupled to the upper chord member, the free end of the lateral side fastening portion, and the fifth lateral side reinforcement member; a plurality of first lateral side reinforcement member which has one end coupled to an inner side at one end of any one pair of lattices among the multiple pairs of lattices, and the other end coupled to an inner side at the other end of another pair of lattices; a pair of third lateral side reinforcement members which is coupled to inner sides of the pair of lattices and lower surfaces of the pair of lower chord members, is disposed perpendicular to the pair of lower chord members, and includes a ㄷ-shaped first coupling portion outside the lateral side deck plate; and a pair of fourth lateral side reinforcement members which is disposed in parallel with each other, has one fourth lateral side reinforcement member perpendicularly coupled to an upper side of the upper chord member, and the other fourth lateral side reinforcement member perpendicularly coupled to the pair of lower chord members, and includes a ㄷ-shaped second coupling portion outside the lateral side deck plate.

In addition, the lateral side fastening portion may be formed on the upper chord member.

In addition, the coupling member may include: a first coupling portion which is disposed on the lateral side deck panel; and a vertical coupling member which is disposed in a space formed as the second coupling portions disposed on the adjacent lateral side deck panels cross each other.

In addition, the vertical coupling member may include four bars which define respective sides of the rectangular shape, and connecting portions which connect the bars, and the connecting portion may be formed in a corrugated shape having a predetermined pitch with respect to at least one facing surface perpendicular to the ground surface.

In addition, the vertical coupling member may include an extension portion which is formed in a ㄱ shape and connect the two bars of which the free ends are adjacent to each other, and the pair of extension portions, which faces each other, may be formed at an end of the vertical coupling member.

In addition, a distance between facing surfaces of the pair of extension portions may be longer than a distance between the facing bars.

In addition, the deck panel may further include an auxiliary horizontal coupling member which is disposed in a space formed by the pair of extension portions and an end of another vertical coupling member which is inserted between the pair of extension portions.

In addition, the auxiliary horizontal coupling member may include four bars which define respective sides of the rectangular shape, and connecting portions which connect the bars, and a portion of the connecting portion, which is perpendicular to the ground surface, may be formed in a corrugated shape having a predetermined pitch.

In addition, the deck panel may further include a plurality of hook members which is disposed outside the upper chord member of the lateral side deck panel and seated on the third lateral side reinforcement member disposed on the separate lateral side deck panel.

Advantageous Effects

The present disclosure may provide the deck panel having excellent structural rigidity which may be disposed not only at an upper side of the partitioned building, but also at a lateral side of the partitioned building.

In addition, the present disclosure may provide the deck panel capable of reducing a construction period, and reducing the amount of construction wastes.

In addition, the present disclosure may provide the deck panel which includes a structure in which the deck panels are coupled, and as a result, it is possible to easily and securely couple the partitioned buildings, thereby easily expanding the building.

BEST MODE

Figure 1A:
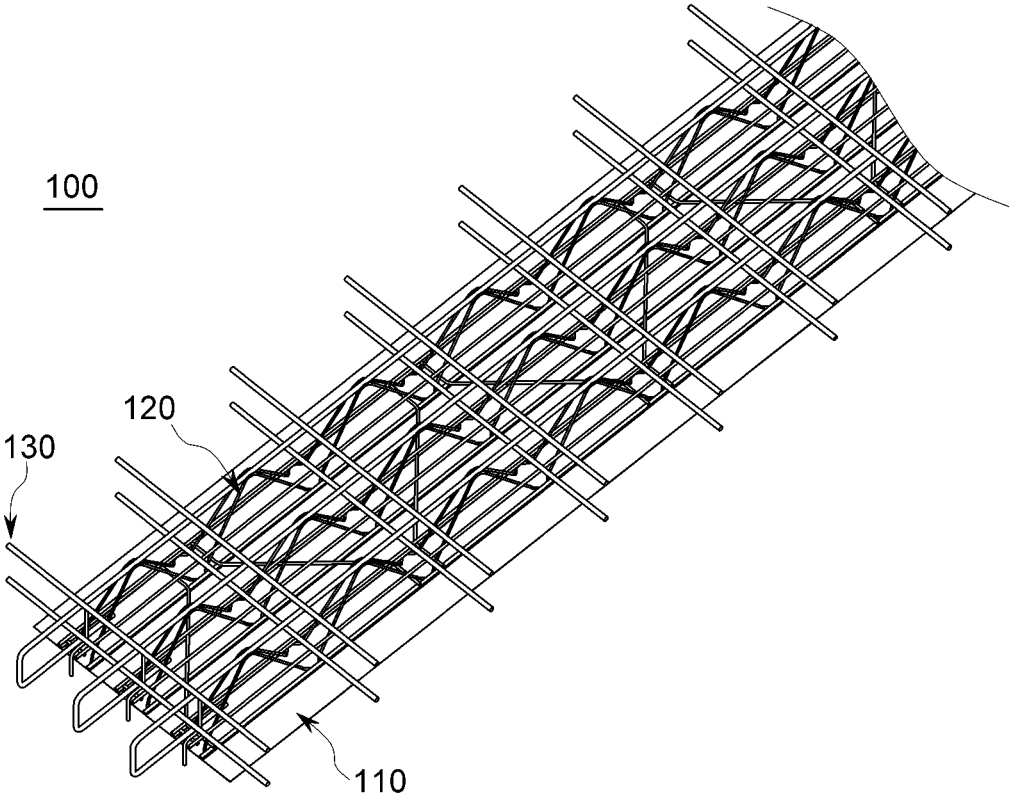
FIG. 1A is a perspective view of an upper side deck panel according to an exemplary embodiment of the present disclosure.

Hereinafter, an exemplary embodiment of the present disclosure will be described in detail with reference to the accompanying drawings.

Unless particularly defined otherwise, all terms used herein have the same meanings as general meanings of terms which are understood by those skilled in the art, and if a term used herein conflicts with a general meaning of the term, the meaning of the term defined herein will supersede the general meaning.

However, the disclosure to be described below is only to explain the exemplary embodiment of the present disclosure but not to limit the scope of the present disclosure, and like reference numerals indicate like constituent elements throughout the specification.

The present disclosure provides a deck panel which has a low height and excellent strength in comparison with a deck panel in the related art, and the deck panel may be disposed not only at an upper side of a building, but also at a lateral side of the building.

The upper side deck panel and the lateral side deck panel have the same basic technical spirit, but have a structural difference, and therefore, the upper side deck panel and the lateral side deck panel will be separately described below in detail.

In addition, a partitioned building described below means a single unit on which the upper side deck panel and the lateral side deck panel according to the exemplary embodiment of the present disclosure are disposed.

Figure 1B:
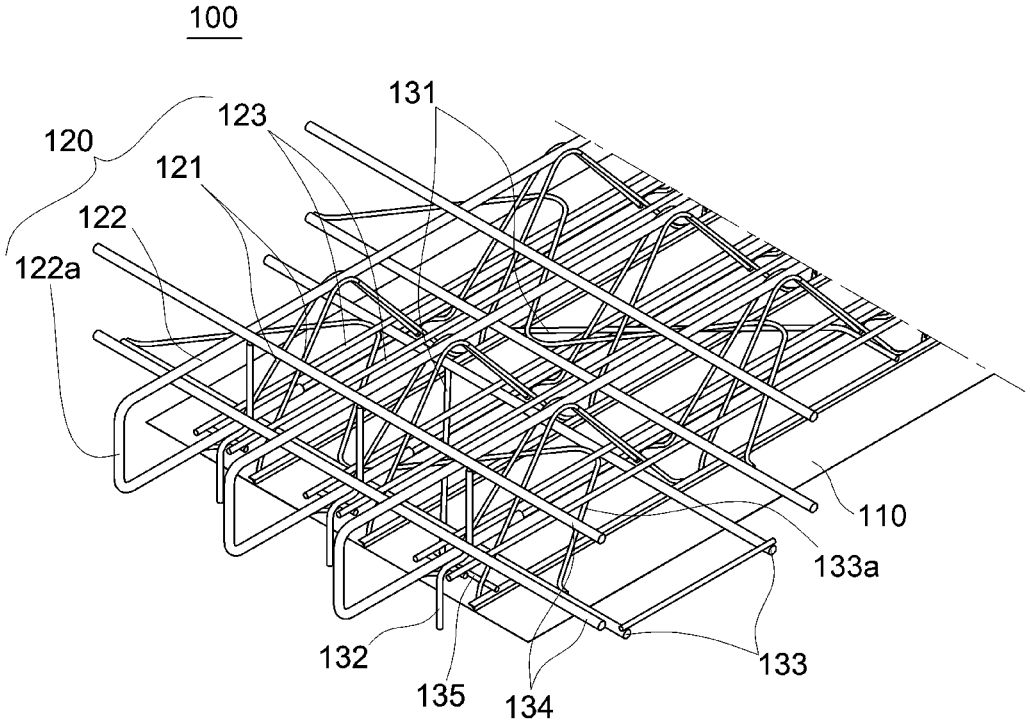
FIG. 1B is a view illustrating a state in which an upper side reinforcement part is additionally disposed on the upper side deck panel according to the exemplary embodiment of the present disclosure.

FIG. 1A is a perspective view of an upper side deck panel according to an exemplary embodiment of the present disclosure, and FIG. 1B is a view illustrating a state in which an upper side reinforcement part is additionally disposed on the upper side deck panel according to the exemplary embodiment of the present disclosure.

An upper side deck panel 100 according to the exemplary embodiment of the present disclosure broadly includes an upper side deck plate 110, upper side truss girders 120, and an upper side reinforcement part 130.

In addition, the upper side deck plate 110 may be formed as a galvanized steel plate or a metallic plate, which is plated with zinc, in order to prevent corrosion caused by concrete which is poured after the upper side deck plate 110 is disposed on a building.

The upper side truss girder 120 may include a pair of lattices 121, upper chord members 122, or lower chord members 123.

Two or more pairs of lattices 121 may be disposed in parallel on the upper side deck plate 110, and as illustrated, a total of three pairs of lattices 121 may be disposed on the single upper side deck plate 110, but the present disclosure is not limited thereto.

Meanwhile, the upper side truss girder 120 may include the upper chord member 122 which is coupled to upper pitches of the pair of lattices 121 and fixes upper portions of the pair of lattices 121.

The upper chord member 122 is a steel reinforcement having a long straight shape, and may be coupled between the upper pitches of the pair of lattices 121, and the coupling method may be implemented by an electric pressure welding method.

In addition, the upper chord member 122 may further include an upper side fastening portion 122*a* which protrudes to the outside of the upper side deck plate 110 and is formed in a ㄷ shape, such that a free end of the upper side fastening portion 122*a* is formed to be disposed to be spaced apart from an upper side of the upper side deck plate 110.

Figure 4A:
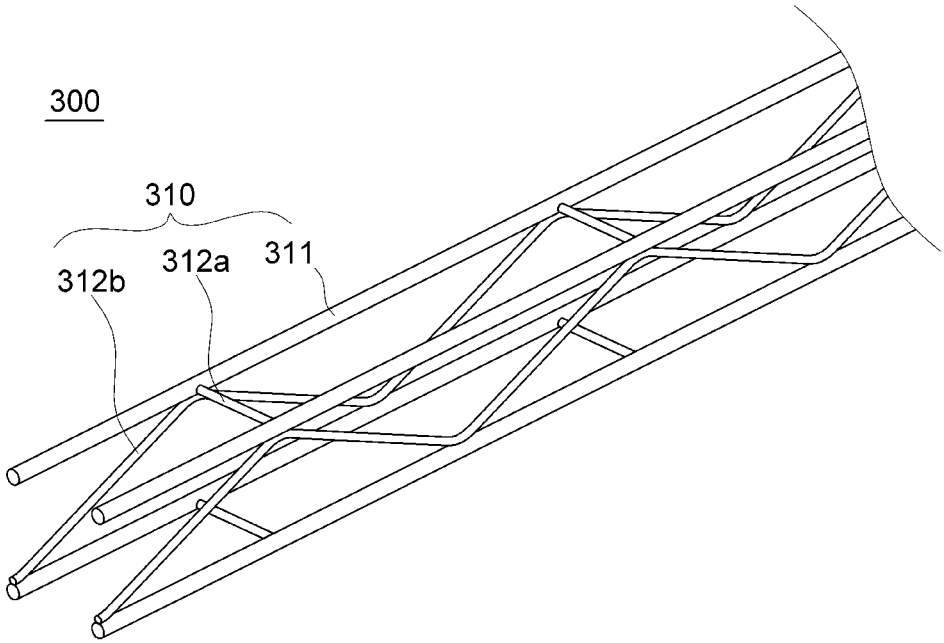
FIG. 4A is a perspective view of a horizontal coupling member according to the exemplary embodiment of the present disclosure.
Figure 4B:
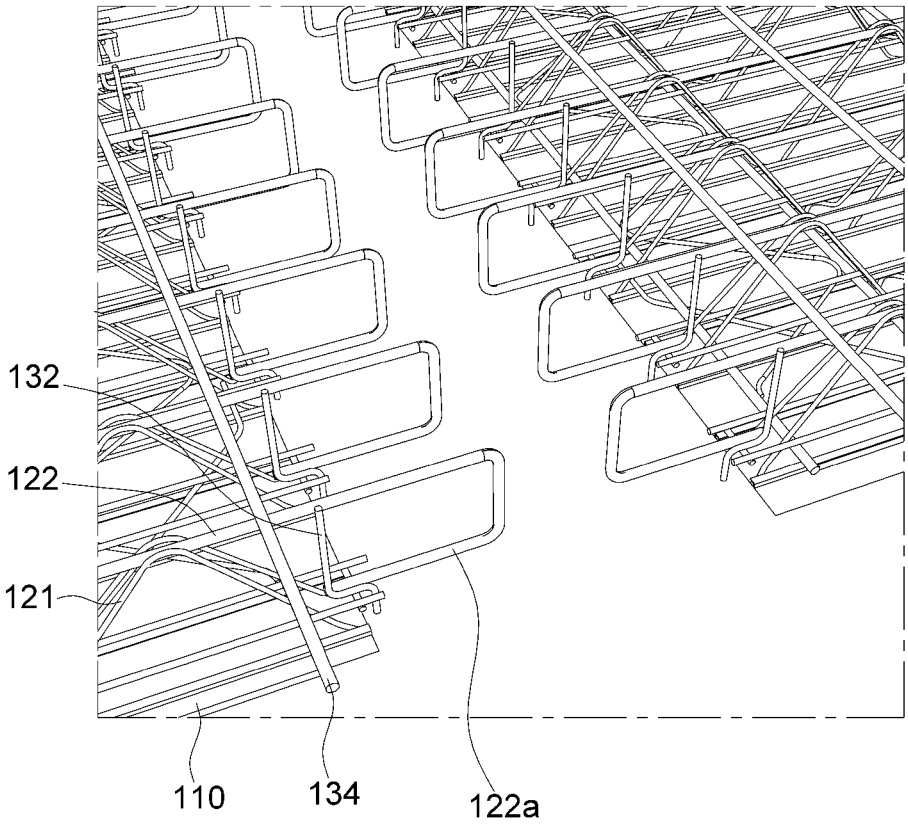
FIG. 4B is a view illustrating a state before the two upper side deck panels according to the exemplary embodiment of the present disclosure are coupled to each other.
Figure 4C:
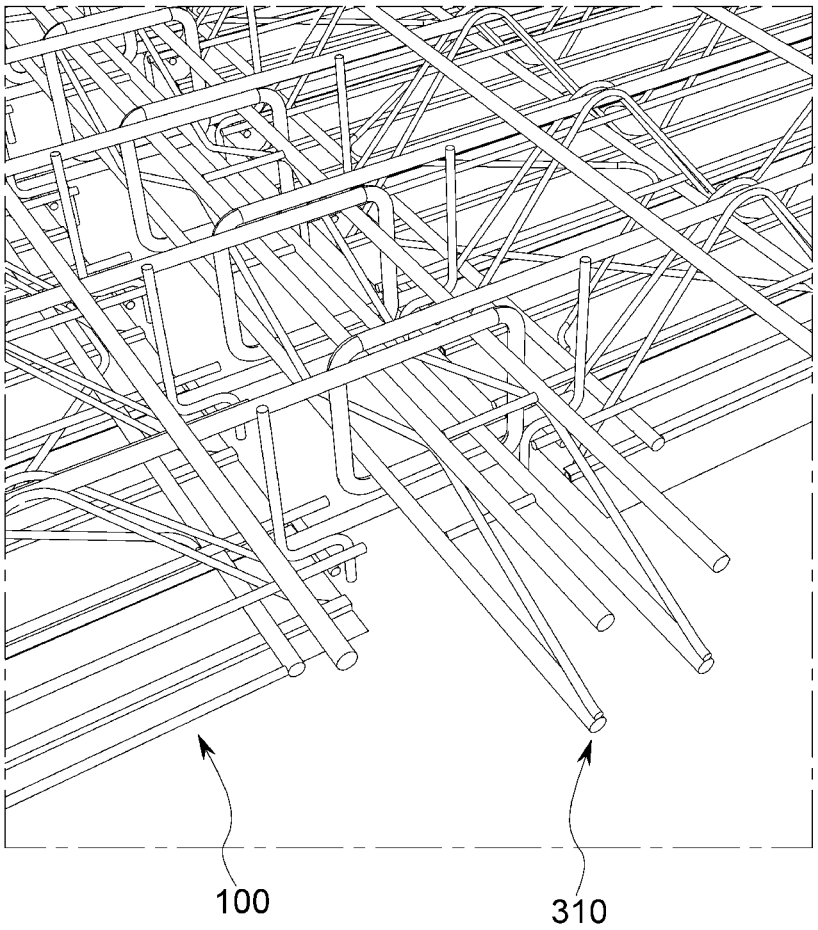
FIG. 4C is a view partially illustrating a state in which the two upper side deck panels according to the exemplary embodiment of the present disclosure are coupled to each other.

The upper side fastening portion 122*a* may be disposed to cross a lateral side fastening portion 222*a* to be described below or cross an upper side fastening portion of another construction module as illustrated in FIGS. 4B and 4C, and a horizontal coupling member to be described below is inserted into an internal space formed accordingly, such that overall mechanical strength may be improved.

Meanwhile, the upper side truss girder 120 may include the pair of lower chord members 123 which are disposed at lower sides of the pair of lattices 121, respectively, and disposed in parallel so as to be spaced apart from the upper side deck plate 110 at a predetermined interval.

First upper side reinforcement members 131 and third upper side reinforcement members 133, which will be described below, may be disposed between the lower chord members 123 spaced apart from the upper side deck plate 110, and this structural feature may further improve mechanical strength of the upper side deck panel 100 of the present disclosure.

In addition, each of the lower chord members 123 is a steel reinforcement having a long straight shape, and the lower chord members 123 may be coupled to lower pitches of the pair of lattices 121, respectively, and the coupling method may be implemented by an electric pressure welding method.

The upper side reinforcement part 130 is coupled to the upper side deck plate 110 and/or the upper side truss girder 120, thereby improving strength of the deck panel 100, and the upper side reinforcement part 130 may include the first upper side reinforcement members 131, second upper side reinforcement members 132, the third upper side reinforcement members 133, fourth upper side reinforcement members 134, or fifth upper side reinforcement members 135.

Each of the reinforcement members of the upper side reinforcement part 130 may be formed as a long steel reinforcement or a bent steel reinforcement.

The first upper side reinforcement member 131 may be formed in a shape that is bent twice such that one end of the first upper side reinforcement member 131 is coupled to one end of any one pair of lattices 121 among the multiple pairs of lattices 121, and the other end of the first upper side reinforcement member 131 is coupled to an inner side at the other end of another pair of lattices 121.

That is, straight shapes of one end and the other end of the first upper side reinforcement member 131 may be coupled to the two pairs of lattices 121 disposed at outermost sides of the single upper side deck plate 110, and an intermediate portion of the first upper side reinforcement member 131 may be formed to have a diagonal shape that connects one end and the other end of the first upper side reinforcement member 131.

In addition, the first upper side reinforcement member 131 may be disposed, one for each pitch of a corrugated shape of the lattice 121, and the plurality of first upper side reinforcement members 131 may be disposed to correspond to the adjacent first upper side reinforcement members 131 or in the same direction.

The second upper side reinforcement member 132 may be coupled to the upper chord member 122, the free end of the upper side fastening portion 122*a*, and the fifth upper side reinforcement member 135 to be described below, and the second upper side reinforcement member 132 may be formed in a shape which is bent twice approximately at a right angle.

The third upper side reinforcement members 133 may be disposed as a pair of third upper side reinforcement members 133 which is coupled to inner sides of the pair of lattices 121 and lower surfaces of the pair of lower chord members 123, and disposed perpendicular to the pair of lower chord members 123.

The third upper side reinforcement members 133 may be disposed at an equal interval on the upper side deck plate 110 which is disposed at an entire upper side of a building, or the third upper side reinforcement members 133 may be disposed only at an edge of the upper side deck plate 110.

The fourth upper side reinforcement members 134 may be disposed as a pair of fourth upper side reinforcement members 134 disposed in parallel with each other, in which one fourth upper side reinforcement member 134 is perpendicularly coupled to an upper side of the upper chord member 122, and the other fourth upper side reinforcement member 134 is perpendicularly coupled to the pair of lower chord members 123.

In addition, an auxiliary reinforcement member 133*a* having a truss structure may be disposed between the pair of third upper side reinforcement members 133 or the pair of fourth upper side reinforcement members 134 in order to improve mechanical strength.

A central portion of the fifth upper side reinforcement member 135 may be coupled to the free end of the upper side fastening portion 122*a*, and both ends of the fifth upper side reinforcement member 135 may be coupled to the pair of lower chord members 123, respectively.

That is, the deck panel 100 of the present disclosure, which includes the upper side reinforcement part 130 according to the exemplary embodiment of the present disclosure, may reduce a vacant space between the truss girders 120, implement excellent durability of a building in comparison with the related art, reduce the amount of concrete to be poured, reduce construction costs and a concrete curing period, and consequently reduce construction costs.

Here, the lattice 121, the upper chord member 122, or the lower chord member 123 may be elongated in parallel with a long side of the upper side deck plate 110.

In addition, the third upper side reinforcement member 133, the fourth upper side reinforcement member 134, or the fifth upper side reinforcement member 135 may be formed in parallel with a short side of the upper side deck plate 110.

In addition, the constituent elements may be coupled by means of welding or separate coupling members, but may be coupled by the electric pressure welding method.

Hereinafter, the lateral side deck panel according to the exemplary embodiment of the present disclosure will be described.

Figure 2A:
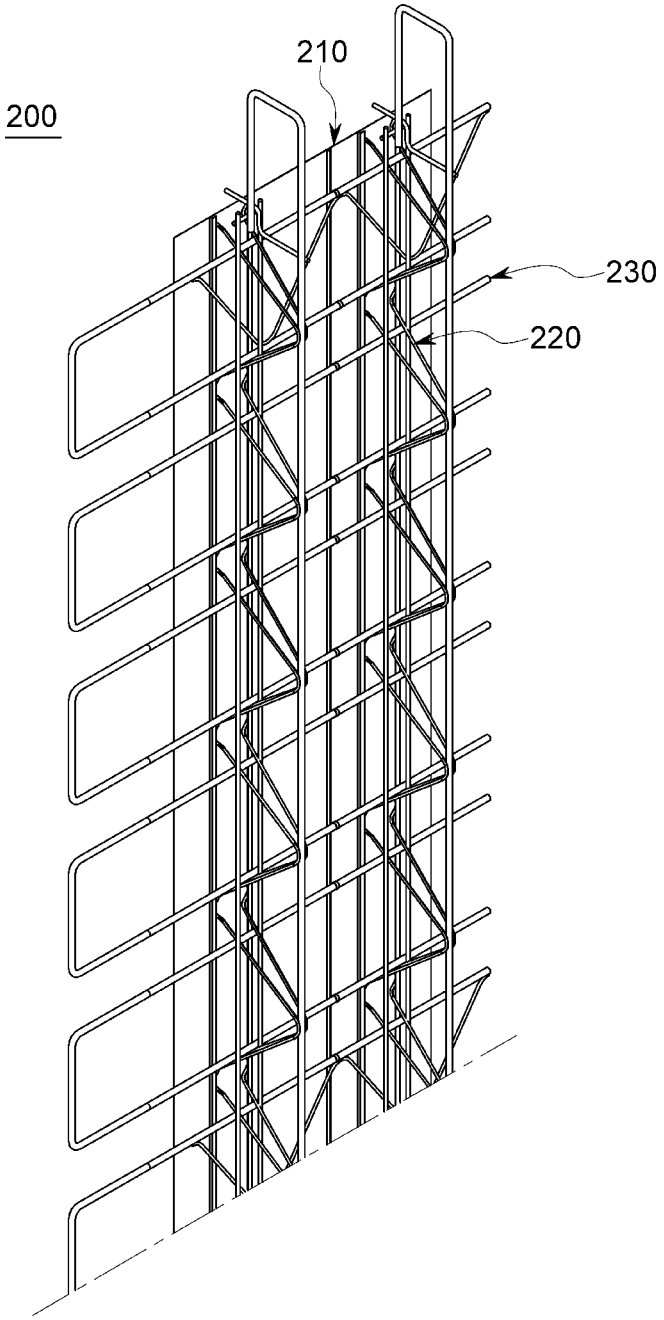
FIG. 2A is a perspective view of a lateral side deck panel according to the exemplary embodiment of the present disclosure.
Figure 2B:
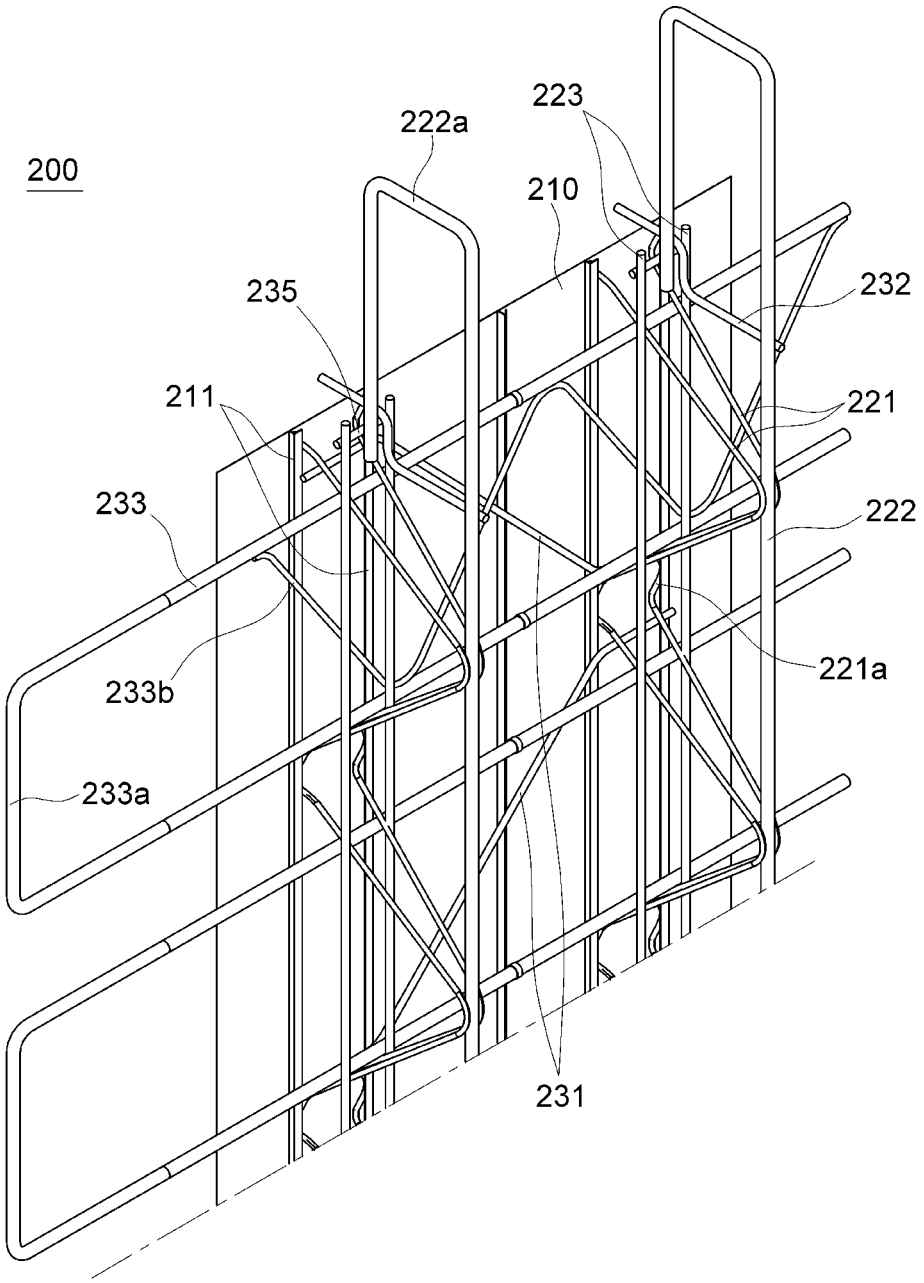
FIG. 2B is a partially enlarged view of the lateral side deck panel according to the exemplary embodiment of the present disclosure.
Figure 2C:
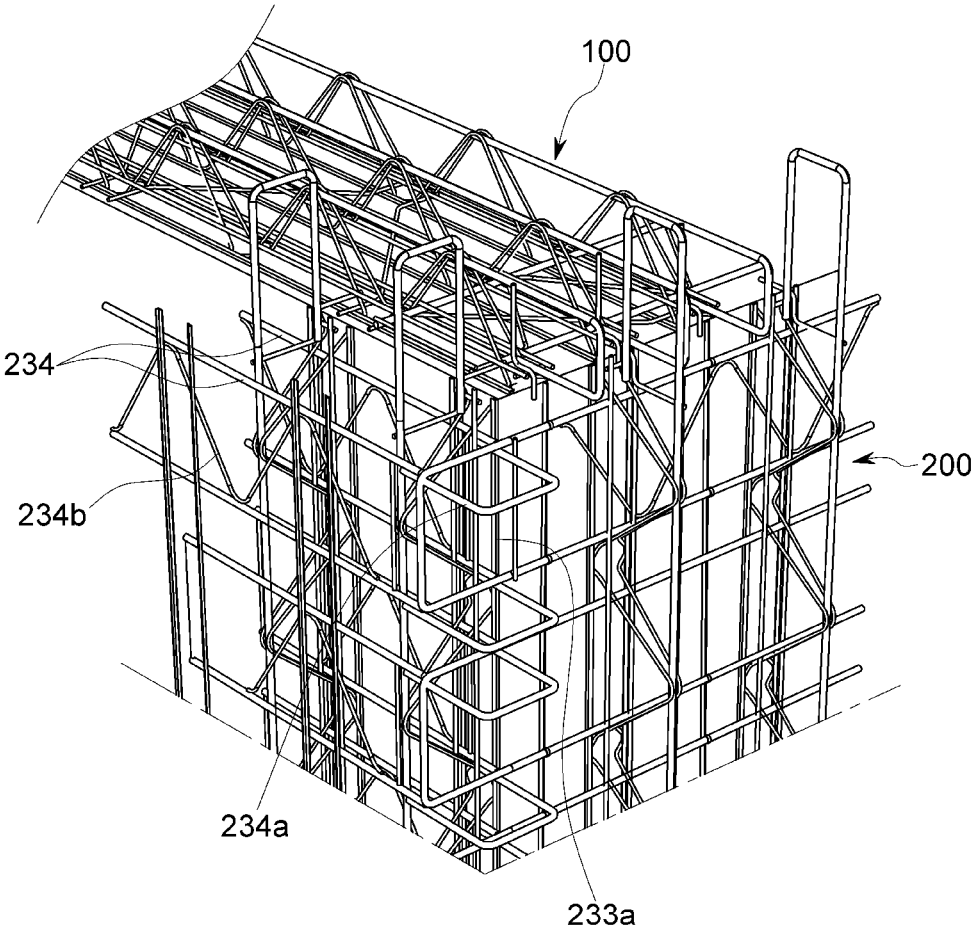
FIG. 2C is a view illustrating a state in which the upper side deck panel and the lateral side deck panel according to the exemplary embodiment of the present disclosure are disposed.

FIG. 2A is a perspective view of a lateral side deck panel according to the exemplary embodiment of the present disclosure, FIG. 2B is a partially enlarged view of the lateral side deck panel according to the exemplary embodiment of the present disclosure, and FIG. 2C is a view illustrating a state in which the upper side deck panel and the lateral side deck panel according to the exemplary embodiment of the present disclosure are disposed.

A lateral side deck panel 200 according to the exemplary embodiment of the present disclosure broadly includes a lateral side deck plate 210, lateral side truss girders 220, and lateral side reinforcement parts 230.

In addition, the lateral side deck plate 210 may be formed as a galvanized steel plate or a metallic plate, which is plated with zinc, in order to prevent corrosion caused by concrete which is poured after the upper side deck plate 110 is disposed on a building.

The lateral side truss girder 220 may include a pair of lattices 221, upper chord members 222, or lower chord members 223.

Specifically, two or more pairs of lattices 221 may be disposed in parallel on the lateral side deck plate 210, and as illustrated, a total of two pairs of lattices 221 may be disposed on the single lateral side deck plate 210.

Meanwhile, the lateral side truss girder 220 may include the upper chord member 222 which is coupled to upper pitches of the pair of lattices 221 and fixes upper portions of the pair of lattices 221.

The upper chord member 222 is a steel reinforcement having a long straight shape, and may be coupled between the upper pitches of the pair of lattices 221, and the coupling method may be implemented by an electric pressure welding method.

In addition, the upper chord member 222 may further include a lateral side fastening portion 222*a* which protrudes to the outside of the lateral side deck plate 210 and is formed in a ㄱ shape, such that a free end of the lateral side fastening portion 222*a* is formed to be disposed to be spaced apart from an upper side of the lateral side deck plate 210.

Figure 3A:
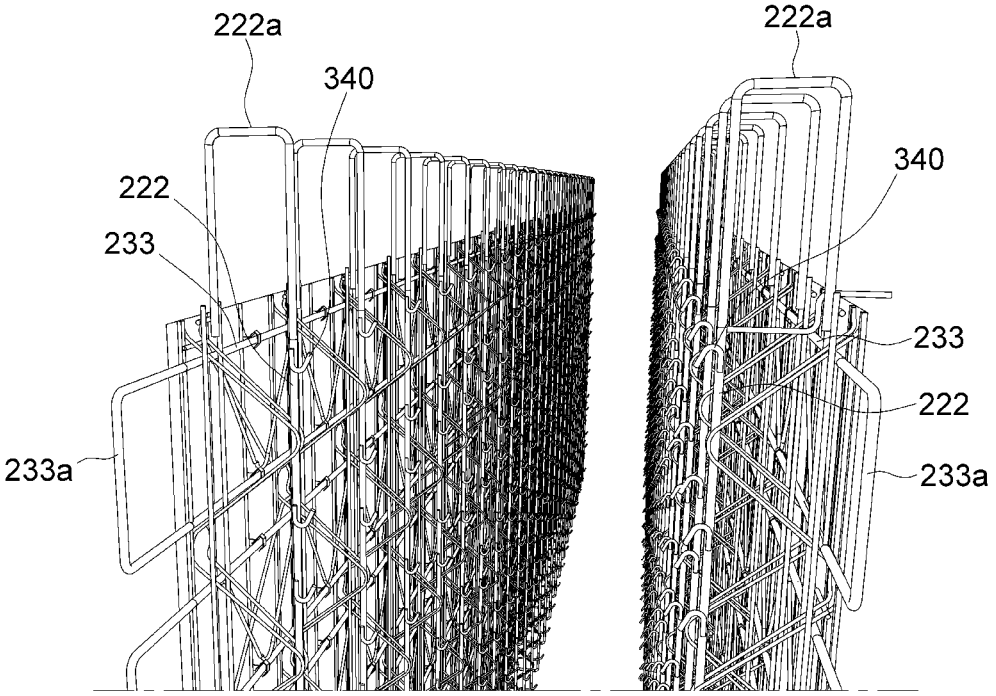
FIG. 3A is a view partially illustrating a state before the two lateral side deck panels, which have hook members disposed thereon, according to the exemplary embodiment of the present disclosure are coupled to each other.
Figure 3B:
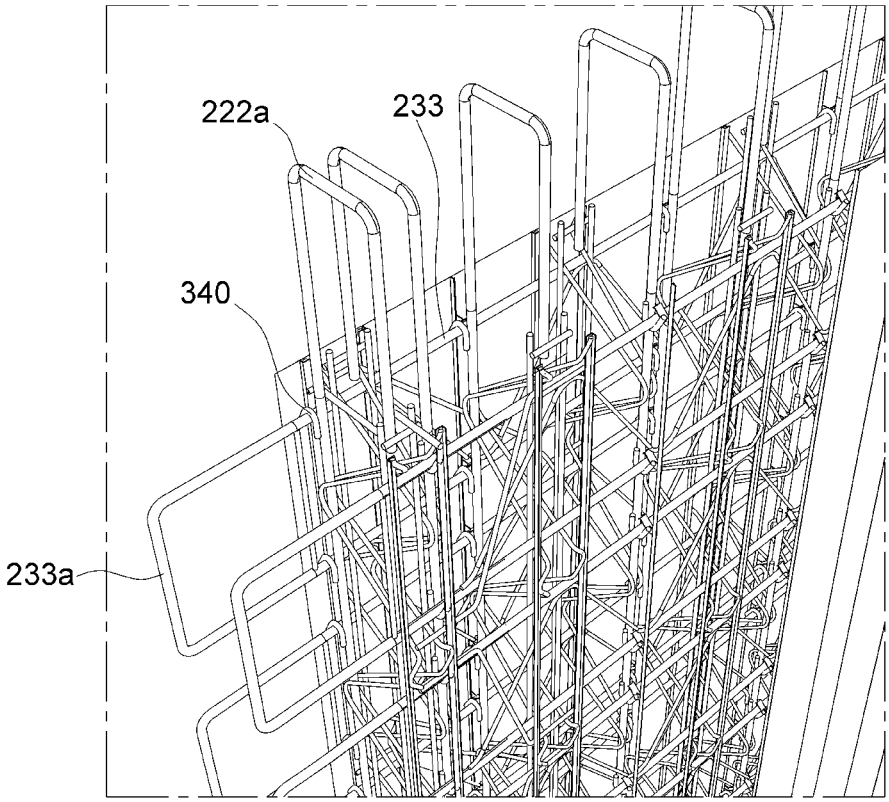
FIG. 3B is a view partially illustrating a state in which the two lateral side deck panels, which have the hook members disposed thereon, according to the exemplary embodiment of the present disclosure are coupled to each other.

The lateral side fastening portion 222*a* may be disposed to cross the upper side fastening portion 122*a* or cross a lateral side fastening portion of another construction module as illustrated in FIG. 3B, and in a case in which another partitioned building is additionally constructed on the lateral side fastening portion 222*a*, the lateral side fastening portion 222*a* supports a coupled deck panel module or a structure of concrete poured above the lateral side fastening portion 222*a*, thereby improving overall mechanical strength.

Meanwhile, the lateral side truss girder 220 may include the pair of lower chord members 223 which are disposed at lower sides of the pair of lattices 221, respectively, and disposed in parallel so as to be spaced apart from the lateral side deck plate 210 at a predetermined interval.

Therefore, first lateral side reinforcement members 231 and third lateral side reinforcement members 233, which will be described below, may be disposed between the lower chord members 223 spaced apart from the lateral side deck plate 210, and this structural feature may further improve mechanical strength of the lateral side deck panel 200 of the present disclosure.

In addition, each of the lower chord members 223 is a steel reinforcement having a long straight shape, and the lower chord members 223 may be coupled to lower pitches of the pair of lattices 221, respectively, and the coupling method may be implemented by the electric pressure welding method.

Meanwhile, the construction method in the related art does not use a process of pouring concrete by using the deck panel at a lateral side of a building. The reason is that a load of the poured concrete is more greatly applied to the lateral side than the upper side, and thus the deck panel of the related art does not permit the load of the concrete.

However, because the lateral side deck panel 200 of the present disclosure has excellent mechanical strength, the lateral side deck panel 200 may also be applied to a lateral side of a building, which may reduce a construction period and efficiently ensure an internal space.

In addition, since the lateral side deck panel 200 may be implemented, the partitioned buildings, which have the upper side deck panel 100 and the lateral side deck panel 200 disposed thereon, may be significantly easily coupled, such that a construction period is greatly reduced, and therefore, construction costs may be reduced, and a rigid lateral side may be formed.

Specifically, the lateral side reinforcement part 230 is coupled to the lateral side deck plate 210 and/or the lateral side truss girder 220, thereby improving strength of the deck panel 200, and the lateral side reinforcement part 230 may include the first lateral side reinforcement members 231, second lateral side reinforcement members 232, the third lateral side reinforcement members 233, fourth lateral side reinforcement members 234, or fifth lateral side reinforcement members 235.

Each of the reinforcement members of the lateral side reinforcement part 230 may be formed as a long steel reinforcement or a bent deformed steel reinforcement.

The first lateral side reinforcement member 231 may be formed in a shape that is bent twice such that one end of the first lateral side reinforcement member 231 is coupled to an inner side at one end of any one pair of lattices 221 among the multiple pairs of lattices 221, and the other end of the first lateral side reinforcement member 231 is coupled to an inner side at the other end of another pair of lattices 221.

That is, straight shapes of one end and the other end of the first lateral side reinforcement member 231 may be coupled to the two pairs of lattices 221 disposed at outermost sides of the single lateral side deck plate 210, and an intermediate portion of the first lateral side reinforcement member 231 may be formed to have a diagonal shape that connects one end and the other end of the first lateral side reinforcement member 231.

In addition, the first lateral side reinforcement member 231 may be disposed, one for each pitch of a corrugated shape of the lattice 221, and the plurality of first lateral side reinforcement members 231 may be disposed to correspond to the adjacent first lateral side reinforcement member 231 or in the same direction.

The second lateral side reinforcement member 232 may be coupled to the upper chord member 222, the free end of the lateral side fastening portion 222*a*, and the fifth lateral side reinforcement member 235 to be described below, and the second lateral side reinforcement member 232 may be formed in a shape which is bent twice approximately at a right angle.

In addition, the third lateral side reinforcement member 233 may be disposed as a pair of third lateral side reinforcement members 233 which is coupled to inner sides of the pair of lattices 221 and lower surfaces of the pair of lower chord members 223, and disposed perpendicular to the pair of lower chord members 223.

The third lateral side reinforcement members 233 may be disposed at an equal interval on the upper side deck plate 210 which is disposed at an entire upper side of a building, or the third lateral side reinforcement members 233 may be disposed only at an edge of the upper side deck plate 210, but in consideration of a load of concrete, the plurality of third lateral side reinforcement members 233 may be disposed at an equal interval as illustrated.

In addition, the third lateral side reinforcement member 233 may include a ㄷ-shaped first coupling portion 233*a* outside the lateral side deck plate 210. The first coupling portion 233*a* crosses a second coupling portion 234*a* of the fourth lateral side reinforcement member 234 to be described below at a side adjacent to the first coupling portion 233*a*, thereby improving mechanical strength of the deck panel 200.

The fourth lateral side reinforcement members 234 may be disposed as a pair of fourth lateral side reinforcement members 234 disposed in parallel with each other, in which one fourth lateral side reinforcement member 234 is perpendicularly coupled to an upper side of the upper chord member 222, and the other fourth lateral side reinforcement member 234 is perpendicularly coupled to the pair of lower chord members 223.

In addition, the fourth lateral side reinforcement member 234 may include a ㄷ-shaped second coupling portion 234*a* outside the lateral side deck plate 210. The second coupling portion 234*a* crosses the first coupling portion 233*a* at a side adjacent to the second coupling portion 234*a* or crosses the second coupling portion 234*a* at a side adjacent to the second coupling portion 234*a*, thereby improving mechanical strength of the deck panel 200.

Figure 5A:
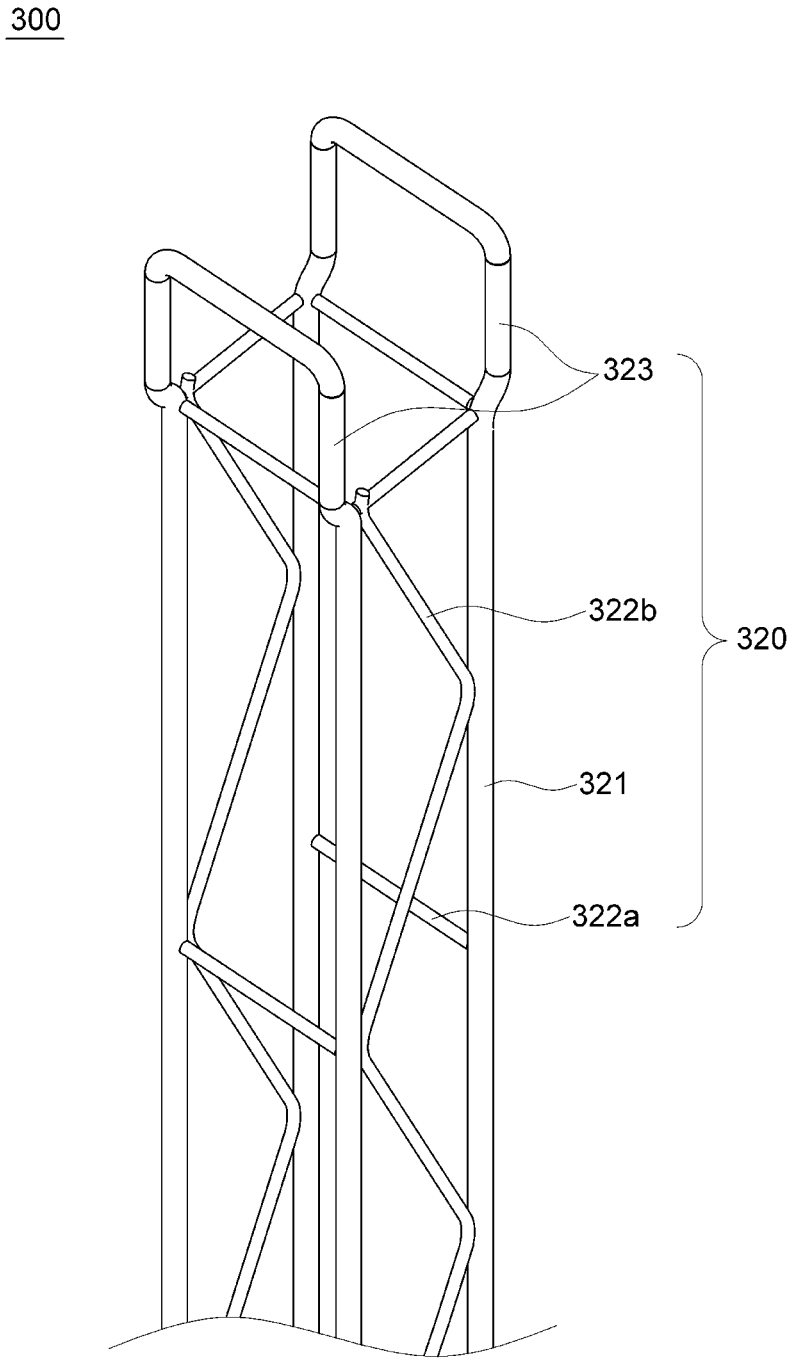
FIG. 5A is a perspective view of a vertical coupling member according to the exemplary embodiment of the present disclosure.
Figure 5B:
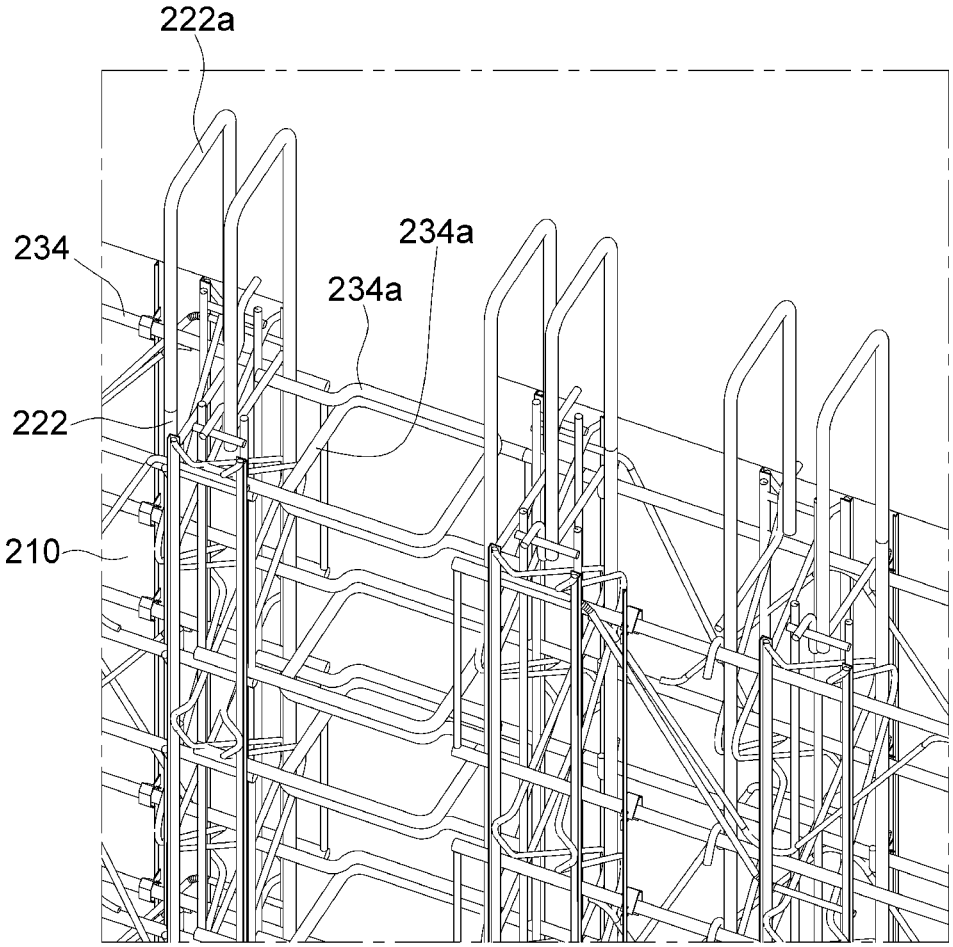
FIG. 5B is a view partially illustrating a state in which the two lateral side deck panels according to the exemplary embodiment of the present disclosure are horizontally coupled to each other.
Figure 5C:
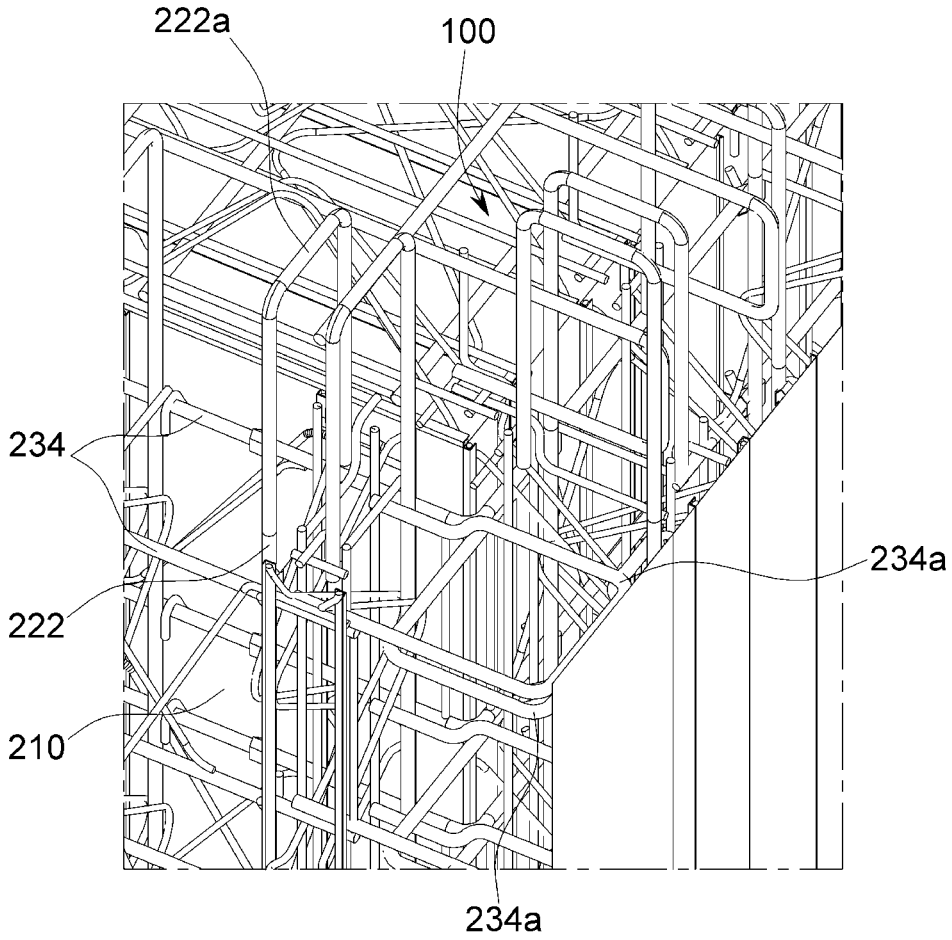
FIG. 5C is a view partially illustrating a state in which the two lateral side deck panels according to the exemplary embodiment of the present disclosure are coupled to each other in a ㄱ shape.
Figure 5D:
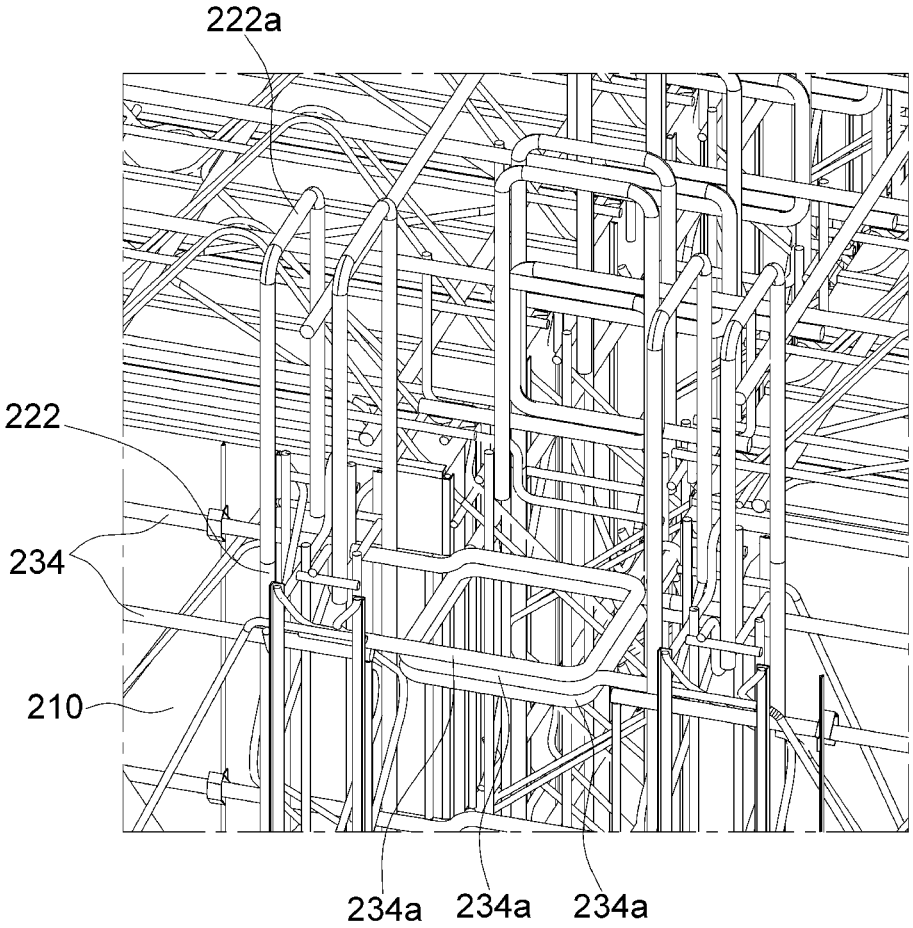
FIG. 5D is a view partially illustrating a state in which the three lateral side deck panels according to the exemplary embodiment of the present disclosure are coupled to one another in a ㅗ shape.
Figure 5E:
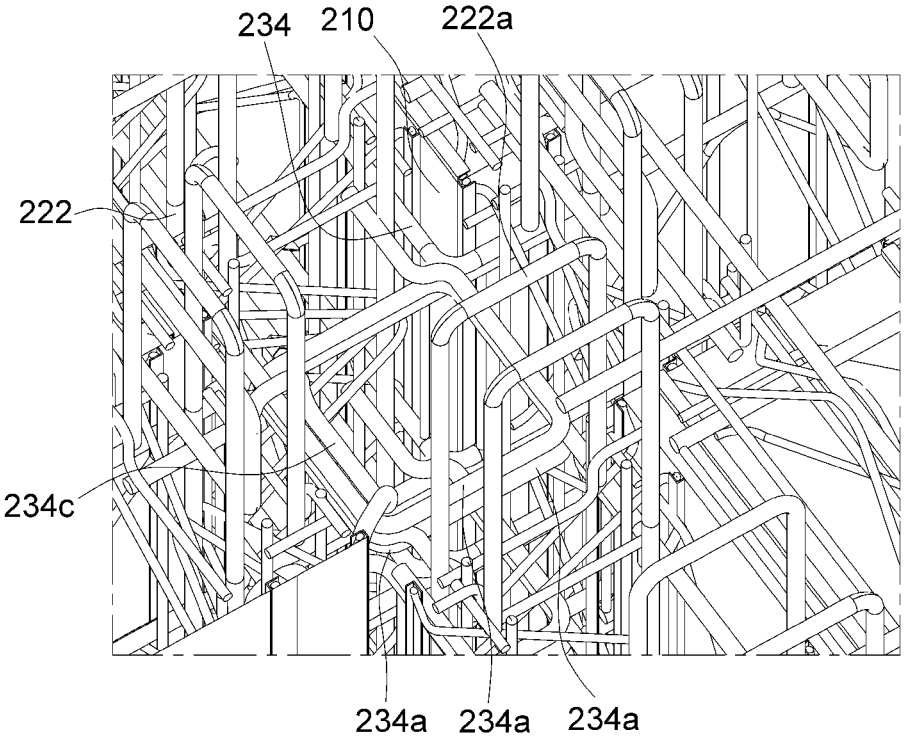
FIG. 5E is a view partially illustrating a state in which the two lateral side deck panels according to the exemplary embodiment of the present disclosure are coupled to each other in a + shape.

Meanwhile, referring to FIG. 5E, the second coupling portion 234*a* may further include a hook-shaped second coupling portion 234*c* as a modified example. The hook-shaped second coupling portion 234*c* may be formed to be seated at one side of the second coupling portion 234*a* at a side adjacent to the second coupling portion 234*c*.

In addition, auxiliary reinforcement members 233*b* and 234*b* having a truss structure may be disposed between the pair of third lateral side reinforcement members 233 or the pair of fourth lateral side reinforcement members 234 in order to improve mechanical strength.

The fifth lateral side reinforcement member 235 may be coupled to the free end of the lateral side fastening portion 222*a*, and both ends of the fifth lateral side reinforcement member 235 may be coupled to the pair of lower chord members 223, respectively.

That is, the lateral side deck panel 200 of the present disclosure, which includes the lateral side reinforcement part 230 according to the exemplary embodiment of the present disclosure, may reduce a vacant space between the truss girders 220, implement excellent durability of a building in comparison with the related art, reduce the amount of concrete to be poured, reduce construction costs and a concrete curing period, and consequently reduce construction costs.

Here, the lattice 221, the upper chord member 222, or the lower chord member 223 may be elongated in parallel with a long side of the lateral side deck plate 210.

In addition, the third lateral side reinforcement member 233, the fourth lateral side reinforcement member 234, or the fifth lateral side reinforcement member 235 may be formed in parallel with a short side of the lateral side deck plate 210.

In addition, the constituent elements may be coupled by means of welding or separate coupling members, but may be coupled by the electric pressure welding method.

As illustrated in FIG. 2C, according to the present disclosure, the lateral side deck panel 200 may be disposed on a sidewall of a building separately from the upper side deck panel 100.

As described above, the disposition on the sidewall may improve strength of the sidewall, may significantly reduce a construction period and construction costs because no mold is required, and may make it easy to couple the respective partitioned buildings.

Therefore, the present disclosure may include coupling members 300 in order to couple or fix the upper side deck panels 100 and/or the lateral side deck panels 200. The coupling members 300 broadly include hook members 340, a horizontal coupling member 310, a vertical coupling member 320, or an auxiliary horizontal coupling member 330.

As drawings for mainly explaining the hook member 340 according to the exemplary embodiment of the present disclosure, FIG. 3A is a view partially illustrating a state before the two lateral side deck panels 200, which have the hook members 340 disposed thereon, according to the exemplary embodiment of the present disclosure are coupled to each other, and FIG. 3B is a view partially illustrating a state in which the two lateral side deck panels 200, which have the hook members 340 disposed thereon, according to the exemplary embodiment of the present disclosure are coupled to each other.

As drawings for mainly explaining the horizontal coupling member 310 according to the exemplary embodiment of the present disclosure, FIG. 4A is a perspective view of the horizontal coupling member 310 according to the exemplary embodiment of the present disclosure, FIG. 4B is a view illustrating a state before the two upper side deck panels 100 according to the exemplary embodiment of the present disclosure are coupled to each other, and FIG. 4C is a view partially illustrating a state in which the two upper side deck panels 100 according to the exemplary embodiment of the present disclosure are coupled to each other.

As drawings for mainly explaining the vertical coupling member 320 according to the exemplary embodiment of the present disclosure, FIG. 5A is a perspective view of the vertical coupling member 320 according to the exemplary embodiment of the present disclosure, FIG. 5B is a view partially illustrating a state in which the two lateral side deck panels 200 according to the exemplary embodiment of the present disclosure are horizontally coupled to each other, FIG. 5C is a view partially illustrating a state in which the two lateral side deck panels 200 according to the exemplary embodiment of the present disclosure are coupled to each other in a ⊓ shape, FIG. 5D is a view partially illustrating a state in which the three lateral side deck panels 200 according to the exemplary embodiment of the present disclosure are coupled to one another in a ⊥ shape, and FIG. 5E is a view partially illustrating a state in which the two lateral side deck panels 200 according to the exemplary embodiment of the present disclosure are coupled to each other in a + shape.

Figure 6A:
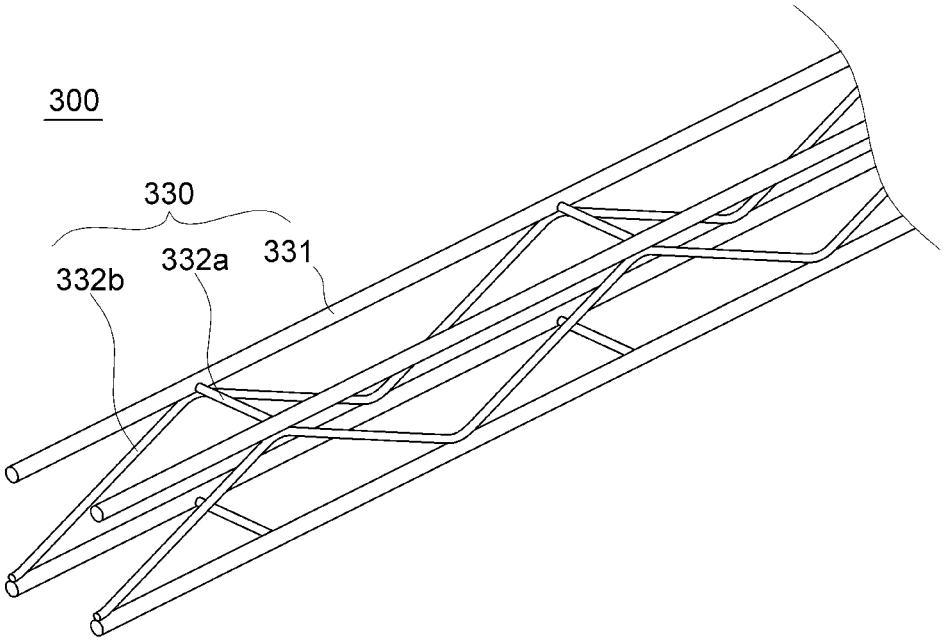
FIG. 6A is a perspective view of an auxiliary horizontal coupling member according to the exemplary embodiment of the present disclosure.
Figure 6B:
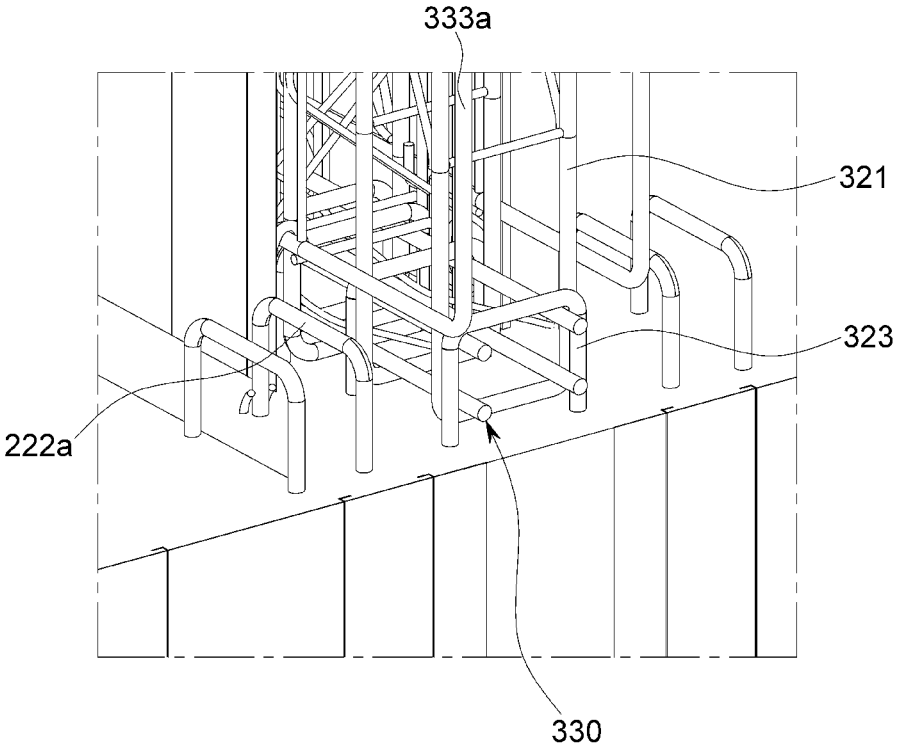
FIG. 6B is a view partially illustrating a state in which the deck panels, which have the auxiliary horizontal coupling member and the vertical coupling member disposed thereon, according to the exemplary embodiment of the present disclosure are coupled to each other.

As drawings for mainly explaining the auxiliary horizontal coupling member 330 according to the exemplary embodiment of the present disclosure, FIG. 6A is a perspective view of the auxiliary horizontal coupling member 330 according to the exemplary embodiment of the present disclosure, and FIG. 6B is a view partially illustrating a state in which the deck panels, which have the auxiliary horizontal coupling member 330 and the vertical coupling member 320 disposed thereon, according to the exemplary embodiment of the present disclosure are coupled to each other.

Referring to FIGS. 3A and 3B, the plurality of hook members 340 according to the exemplary embodiment may be disposed at an equal interval outside the upper chord members 222 of the lateral side deck panel 200.

The hook member 340 may be seated on the third lateral side reinforcement member 233 disposed on the lateral side deck panel 200 of another partitioned building, and as a result, the partitioned buildings may be disposed at a constant interval, and it is possible to provide force that withstands a load when concrete is poured between the two facing lateral side deck panels 200.

In addition, as illustrated, the hook members 340 are disposed on one lateral side deck panel 200 at an equal interval so as to be opened upward, and the hook members 340 may be disposed on the other lateral side deck panel 200 at an equal interval so as to be opened downward.

That is, the hook members 340 may be provided to couple the partitioned buildings, or maintain an interval with the other lateral side deck panel 200 for forming the sidewall, and increase strength.

Referring to FIGS. 4A to 4C, the coupling members 300 according to the exemplary embodiment of the present disclosure may include the horizontal coupling member 310 disposed in a space formed as the upper side fastening portion 122*a* and the lateral side fastening portion 222*a* cross each other.

The horizontal coupling member 310 may be disposed to securely support respective sides of the single partitioned building or securely and constantly maintain connection between the partitioned buildings. Specifically, referring to FIGS. 3B, 4B. and 6B, the horizontal coupling member 310 may be disposed in a space formed as the upper side fastening portions 122*a* of the adjacent partitioned buildings cross each other or a space formed as the upper side fastening portion 122*a* and the lateral side fastening portion 222*a* cross each other, and may also be penetratively disposed at a lower side of an extension portion 323 of the vertical coupling member 320 to be described below.

To form a rigid structure, the horizontal coupling member 310 may be formed in a rectangular shape, and may be disposed to correspond to a quadrangular space formed by the upper side fastening portion 122*a* and the lateral side fastening portion 222*a* or the vertical coupling member 320.

Therefore, the horizontal coupling member 310 may include four bars 311 which define respective sides of a rectangular shape, and connecting portions 312*a* and 312*b* which connect the adjacent bars, and in consideration of a stress concentration direction caused by the partitioned building or a load of concrete, the connecting portions 312*b* may be formed in a corrugated shape having a predetermined pitch with respect to the facing surfaces perpendicular to the ground surface as illustrated.

Referring to FIGS. 5A to 5E, the coupling member 300 according to the exemplary embodiment of the present disclosure may include a vertical coupling member 320 which is disposed in a space formed as the first coupling portion 233*a*, which is disposed on the lateral side deck panel 200, and the first coupling portion 234*a*, which is disposed on the lateral side deck panel 200 and adjacent to the lateral side deck panel 200, cross each other.

The vertical coupling member 320 may be disposed to securely support respective sides of the single partitioned building or securely and constantly maintain a connection between the partitioned buildings. Specifically, the vertical coupling member 320 may be disposed in a space formed as the first coupling portions 234*a* of the adjacent partitioned buildings cross each other or a space formed as the first coupling portion 233*a* and the first coupling portion 234*a* cross each other on the same partitioned building.

To form a rigid structure, the vertical coupling member 320 may be formed in a rectangular shape, and may be disposed to correspond to a quadrangular space formed by the first coupling portion 233*a* and the first coupling portion 234*a* on the same partitioned building or a quadrangular space formed by the first coupling portions 233*a* of the adjacent partitioned building.

Therefore, the vertical coupling member 320 may include four bars 321 which define respective sides of the rectangular shape, and connecting portions 321*a* and 321*b* which connect the bars, and in consideration of a stress concentration direction caused by the partitioned building or a load of concrete, the connecting portions 321*b* may be formed in a corrugated shape having a predetermined pitch with respect to at least one facing surface perpendicular to the ground surface as illustrated.

In addition, in the present disclosure, the vertical coupling member 320 may include the extension portion 323 which is formed in a ㄷ shape and has a free end that connects the two adjacent bars in order to implement the technical spirit in which the partitioned building may be coupled at the top side.

In addition, a pair of extension portions 323 may be formed at an end of the vertical coupling member 320 so as to face each other.

The extension portion 323 enables a lower end of another vertical coupling member 320 provided on the partitioned building disposed at the top side to be securely and stably disposed.

Therefore, a distance between facing surfaces of the pair of extension portions 323 may be longer than a distance between the facing bars.

Referring to FIGS. 6A and 6B, the coupling member 300 according to the exemplary embodiment of the present disclosure may include the auxiliary horizontal coupling member 330 which is disposed in a space formed by the pair of extension portions 323 and an end of another vertical coupling member 320 inserted between the pair of extension portions 323.

The auxiliary horizontal coupling member 330 may be disposed to securely and constantly maintain connection between the partitioned buildings in a case in which a separate partitioned building is additionally constructed at an upper side of the partitioned building. Specifically, the auxiliary horizontal coupling member 330 may be disposed in a space formed as the vertical coupling members 320, which are disposed on the same line on the partitioned buildings adjacent in an up and down direction, cross each other.

The auxiliary horizontal coupling member 330 may include four bars 331 which define respective sides of the rectangular shape, and connecting portions 332*a* and 332*b* which connect the bars, and in consideration of a stress concentration direction caused by the partitioned building or a load of concrete, the connecting portion 332*b*, which is perpendicular to the ground surface, may be formed in a corrugated shape having a predetermined pitch as illustrated.

In summary, the present disclosure may provide the deck panels 100 and 200 including the coupling member 300 in order to reinforce strength of an edge of the single partitioned building or constantly, stably, and securely couple the respective partitioned buildings.

From the foregoing, it can be understood by those skilled in the art that the present disclosure may be variously changed and modified without departing from the technical spirit of the present disclosure, and the technical scope of the present disclosure is not limited by the contents described in the exemplary embodiment, but should be determined by the claims and the equivalents thereto.

The invention claimed is:

1. A deck panel for construction, comprising:

an upper side deck panel which includes an upper side deck plate, an upper side truss girder which is disposed on the upper side deck plate, an upper side fastening portion which protrudes to outside of the upper side deck plate, and an upper side reinforcement part which is coupled to the upper side deck plate or the upper side truss girder, wherein the upper side deck panel is disposed horizontally with a ground surface, and the upper side truss girder includes: a pair of first lattices which is formed in a predetermined corrugated shape; a first upper chord member which is coupled to upper pitches of the pair of first lattices and fixes upper portions of the pair of first lattices; and a pair of first lower chord members which is disposed in parallel with each other at a lower side of the pair of first lattices;

a lateral side deck panel which includes a lateral side deck plate, a lateral side truss girder which is disposed on the lateral side deck plate, and a lateral side reinforcement part which is coupled to the lateral side deck plate or the lateral side truss girder, a lateral side fastening portion which protrudes to outside of the lateral side deck plate in a direction of the upper side fastening portion, and is disposed on at least one lateral side of the upper side deck panel, wherein the lateral side deck panel is disposed perpendicular to the ground surface, and the lateral side truss girder includes: a pair of second lattices which is formed in a predetermined corrugated shape; a second upper chord member which is coupled to upper pitches of the pair of second lattices and fixes upper portions of the pair of second lattices; and a pair of second lower chord members which is disposed in parallel with each other at a lower side of the pair of second lattices; and a coupling member which couples the upper side deck panel and the lateral side deck panel to each other, wherein the coupling member includes a horizontal coupling member which is disposed in a space formed as the upper side fastening portion and the lateral side fastening portion cross each other.

2. The deck panel of claim 1, wherein the upper side fastening portion is formed in a ㄷ shape and has a free end that is disposed to be spaced apart from an upper side of the upper side deck plate, the lateral side fastening portion is formed in a ㄱ shape and has a free end that is disposed to be spaced apart from an upper side of the lateral side deck plate, and the horizontal coupling member has a rectangular shape.

3. The deck panel of claim 1, wherein the horizontal coupling member includes four bars which define respective sides of a rectangular shape, and connecting portions which connect two adjacent bars, and the connecting portion is formed in a corrugated shape having a predetermined pitch with respect to a facing surface perpendicular to the ground surface.

4. The deck panel of claim 1, wherein the upper side reinforcement part includes:

a fifth upper side reinforcement member which is coupled to a free end of the upper side fastening portion and has both ends coupled to the pair of first lower chord members;

a second upper side reinforcement member which is coupled to the first upper chord member, the free end of the upper side fastening portion, and the fifth upper side reinforcement member;

a plurality of first upper side reinforcement members which has one end coupled to an inner side at one end of any one pair of first lattices among multiple pairs of first lattices, and the other end coupled to an inner side at the other end of the any one pair of first lattices;

a pair of third upper side reinforcement members which is coupled to inner sides of the pair of first lattices and lower surfaces of the pair of first lower chord members, and disposed perpendicular to the pair of first lower chord members; and a pair of fourth upper side reinforcement members which is disposed in parallel with each other, and has one fourth upper side reinforcement member perpendicularly coupled to an upper side of the first upper chord member, and the other fourth upper side reinforcement member perpendicularly coupled to the pair of first lower chord members.

5. The deck panel of claim 1, wherein the upper side fastening portion is formed on the first upper chord member.

6. The deck panel of claim 1, wherein the lateral side reinforcement part includes:

a fifth lateral side reinforcement member which is coupled to a free end of the lateral side fastening portion and has both ends coupled to the pair of second lower chord members;

a second lateral side reinforcement member which is coupled to the second upper chord member, the free end of the lateral side fastening portion, and the fifth lateral side reinforcement member;

a plurality of first lateral side reinforcement member which has one end coupled to an inner side at one end of any one pair of second lattices among multiple pairs of second lattices, and the other end coupled to an inner side at the other end of the any one pair of second lattices;

a pair of third lateral side reinforcement members which is coupled to inner sides of the pair of second lattices and lower surfaces of the pair of second lower chord members, is disposed perpendicular to the pair of second lower chord members, and includes a ㄷ-shaped first coupling portion outside the lateral side deck plate; and a pair of fourth lateral side reinforcement members which is disposed in parallel with each other, has one fourth lateral side reinforcement member perpendicularly coupled to an upper side of the second upper chord member, and the other fourth lateral side reinforcement member perpendicularly coupled to the pair of second lower chord members, and includes a ㄷ-shaped second coupling portion outside the lateral side deck plate.

7. The deck panel of claim 6, further comprising:

a plurality of hook members which is disposed outside the second upper chord member of the lateral side deck panel and seated on the pair of third lateral side reinforcement members disposed on a separate lateral side deck panel.

8. The deck panel of claim 1, wherein the lateral side fastening portion is formed on the second upper chord member.

9. The deck panel of claim 1, wherein the coupling member further includes:

a vertical coupling member which is disposed in a space formed as two adjacent lateral side deck panels cross each other.

10. The deck panel of claim 9, wherein the vertical coupling member includes four bars which define respective sides of a rectangular shape, and connecting portions which connect two adjacent bars, and the connecting portion is formed in a corrugated shape having a predetermined pitch with respect to at least one facing surface perpendicular to the ground surface.

11. The deck panel of claim 10, wherein the vertical coupling member includes an extension portion which is formed in a ㄷ shape and connects the two adjacent bars of which free ends are adjacent to each other, and the extension portion includes a pair of extension portions, which faces each other, is formed at an end of the vertical coupling member.

12. The deck panel of claim 11, wherein a distance between facing surfaces of the pair of extension portions is longer than a distance between the two adjacent bars.

13. The deck panel of claim 12, wherein the coupling member further includes: an auxiliary horizontal coupling member which is disposed in a space formed by the pair of extension portions and an end of another vertical coupling member which is inserted between the pair of extension portions.

14. The deck panel of claim 13, wherein the auxiliary horizontal coupling member includes four bars which define respective sides of a rectangular shape, and connecting portions which connect the two adjacent bars, and a portion of the connecting portion, which is perpendicular to the ground surface, is formed in a corrugated shape having a predetermined pitch.

* * * * *